US005277646A

United States Patent [19]

Fekete et al.

[11] Patent Number: 5,277,646

[45] Date of Patent: Jan. 11, 1994

[54] ANIMATED TOY

[75] Inventors: Ferenc Fekete; Kai Chung-Ho, both of North Point, Hong Kong

[73] Assignee: M-B Sales, Division of the Havi Group Limited Partnership, Westmont, Ill.

[21] Appl. No.: 805,377

[22] Filed: Dec. 10, 1991

[51] Int. Cl.[5] ..... A63H 33/00; A63H 11/00

[52] U.S. Cl. ..... 446/491; 446/353; 446/278

[58] Field of Search ..... 446/175, 353, 354, 297, 446/298, 464, 75, 491, 236, 278, 368

[56] References Cited

U.S. PATENT DOCUMENTS

| | | | |
|---|---|---|---|
| 109,992 | 12/1870 | Fekete et al. . | |
| 222,648 | 12/1879 | Bailey . | |
| 1,266,106 | 5/1918 | Coup . | |
| 1,494,915 | 5/1924 | Irenius | 446/279 X |
| 1,574,035 | 2/1926 | Holtzman | 446/292 |
| 2,775,062 | 12/1956 | Gibson, Jr. et al. | 446/457 X |
| 2,900,758 | 8/1959 | Glass . | |
| 3,260,016 | 7/1966 | Goldfarb | 446/354 |
| 3,613,299 | 10/1971 | Amici et al. | 446/353 |
| 4,052,813 | 10/1977 | Crain et al. | 446/352 |
| 4,419,841 | 12/1983 | Huang . | |
| 4,478,313 | 10/1984 | Wakase . | |
| 4,545,775 | 10/1985 | Kim | 446/299 |
| 4,577,753 | 3/1986 | Marhal | 446/75 X |
| 4,676,764 | 6/1987 | Yeu | 446/298 |
| 4,710,148 | 12/1987 | Nagaoka | 446/464 |
| 4,775,351 | 10/1988 | Provenzano, Jr. | 446/175 |
| 4,903,424 | 2/1990 | Satoh et al. | 40/414 |
| 4,985,883 | 1/1991 | Hou | 446/299 X |
| 5,003,714 | 4/1991 | Satoh et al. | 40/414 |

*Primary Examiner*—Mickey Yu

*Attorney, Agent, or Firm*—Willian Brinks Hofer Gilson & Lione

[57] ABSTRACT

An animated wind up toy, that is safe, durable, lightweight, compact and includes a wind up motor that drives a cam actuated mechanism that causes the toy to move. The wind up toy has an outward contour and coloring that resembles a food item, such as a milk shake, fries or hamburger.

6 Claims, 3 Drawing Sheets

Fig. 4
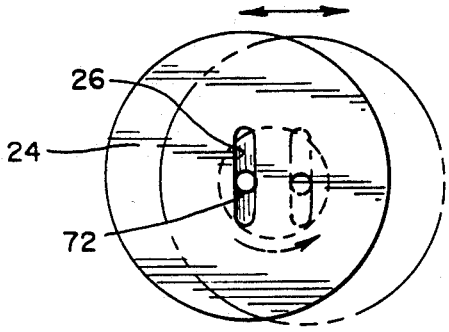
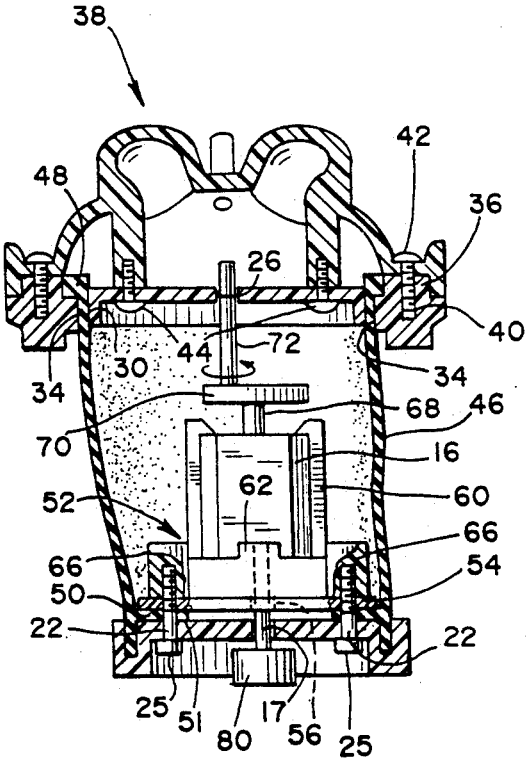
Fig. 2
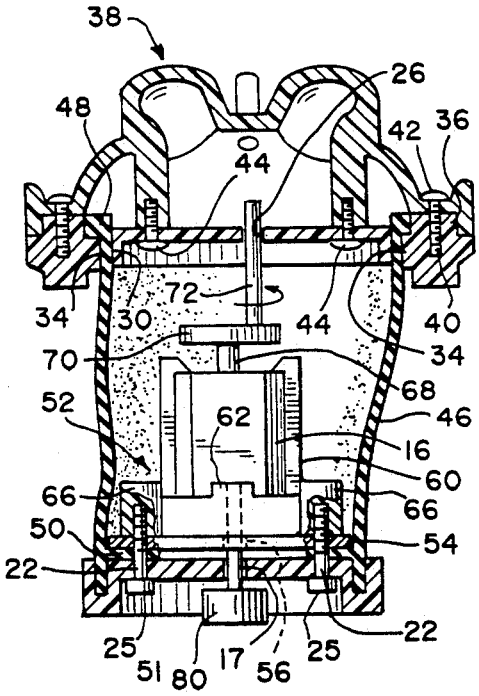
Fig. 3

Fig. 5
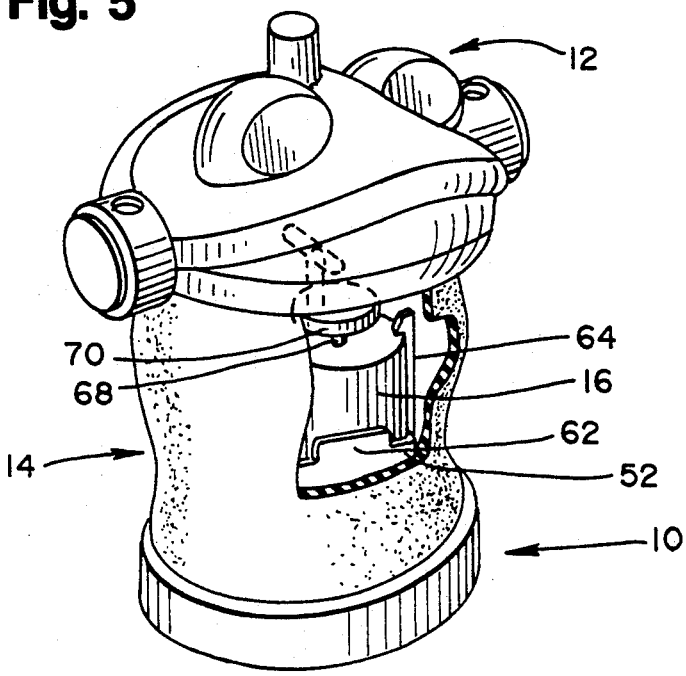
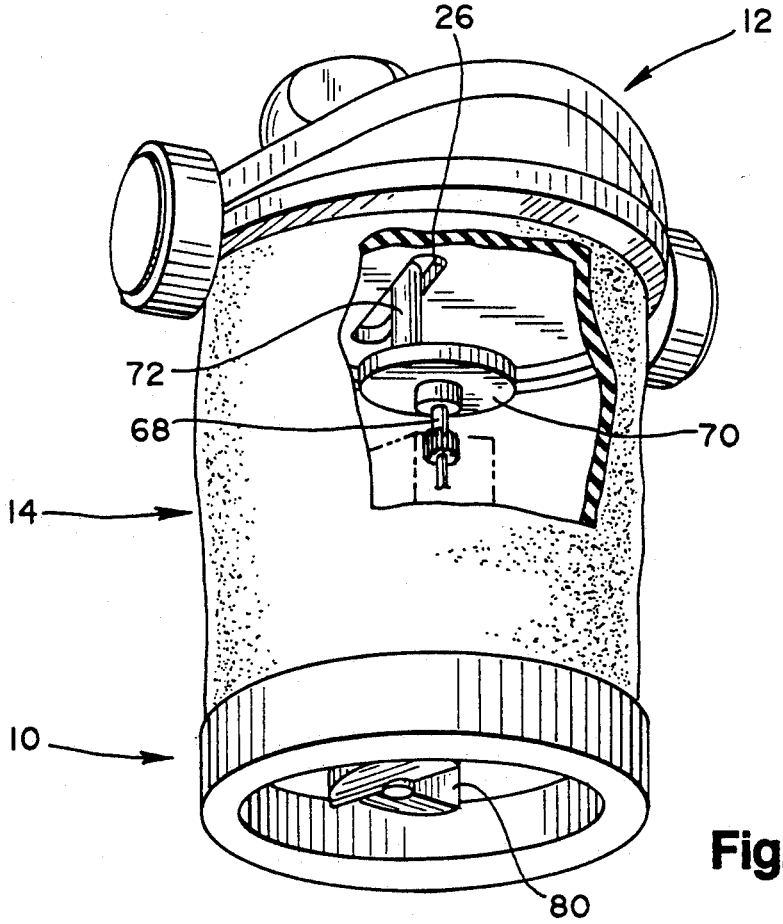
Fig. 6

ANIMATED TOY

BACKGROUND OF THE INVENTION

1. Field of the Invention

The present invention relates generally to a wind up animated toy, that may resemble a food item such as a hamburger, milk shake, package of french fries, chicken nuggets or the like.

2. Description of Prior Art

Dancing or moving toys, that include sound responsive sensors that actuate an electric motor contained in the toy, of the type shown in U.S. Pat. Nos. 4,903,424 and 4,983,890 are known. Toys having actuating mechanism of this type can take the form of a food item such as a soft drink, as in U.S. Pat. Nos. De. 312,674 and 313,261. The electronic/electro-mechanical components of such prior art devices result in their being complex and expensive and not able to withstand being dropped and other abuses that must be expected from small children. Toys intended for play by young children should be safe, durable, lightweight, and compact. Toys for small children should not have sharp edges or pieces that can be easily removed or broken off. Also toys for small children should be inexpensive so that they can be disposed of or replaced when worn, soiled or broken. Further, battery powered children toys are undesirable because the cost of replacing batteries can exceed the initial cost of the toy.

SUMMARY OF THE INVENTION

Briefly, a preferred embodiment of the present invention includes a base upon which is mounted a wind up motor. The motor has an output shaft that drives a cam. A top member is supported on the base by a body portion which includes a vertically extending tube formed from soft thin skin elastomer material such as polyvinyl chloride. The top member, which is also molded from a plastic material, carries a cam follower that reacts with the cam causing the top member to rock back and forth and to impart movement to the soft thin skin of the vertical tube.

An important advantage of the present invention is that it is constructed as a sturdy, lightweight, compact self contained unit without slimsy extensions that will fall or break off and without sharp edges that could cut or scratch an individual playing with the toy.

Another advantage of the present invention is that it is powered by a wind up motor and thus does not require the continual replacement of batteries.

It is a primary objective of the present inventions to provide a safe, durable, and lightweight animated toy.

Another objective of the present invention to provide an animated toy that can be powered by a wind up motor.

Still another objective of the present invention is to provide the basic mechanisms for an animated toy that can take the form of a number of food items.

These and other objects and advantages of the present invention will no doubt become apparent to those skilled in the art after having read the following detailed description of the preferred embodiment which are contained in and illustrated by the various drawing figures.

BRIEF DESCRIPTION OF THE DRAWING

FIG. 2 is a cross section view of the assembled animated wind up toy, with the cam and cam follower in one extreme position, in accordance with the present invention.

FIG. 3 is a cross section view of the assembled animated wind up toy, with the cam and cam follower in the other extreme position, in accordance with the present invention.

FIG. 4 is an isolated view of the cam and cam follower in the extreme positions of FIGS. 2 and 3.

FIG. 5 is a perspective view, looking down, of the animated wind up toy, in the form of a milk shake, having a section of the body broken away so that the motor can be seen.

FIG. 6 is a perspective view, looking up, of the animated wind up toy having a section of the body broken away so that the cam and cam follower can be seen.

DETAILED DESCRIPTION OF THE PREFERRED EMBODIMENT

Figure 1:
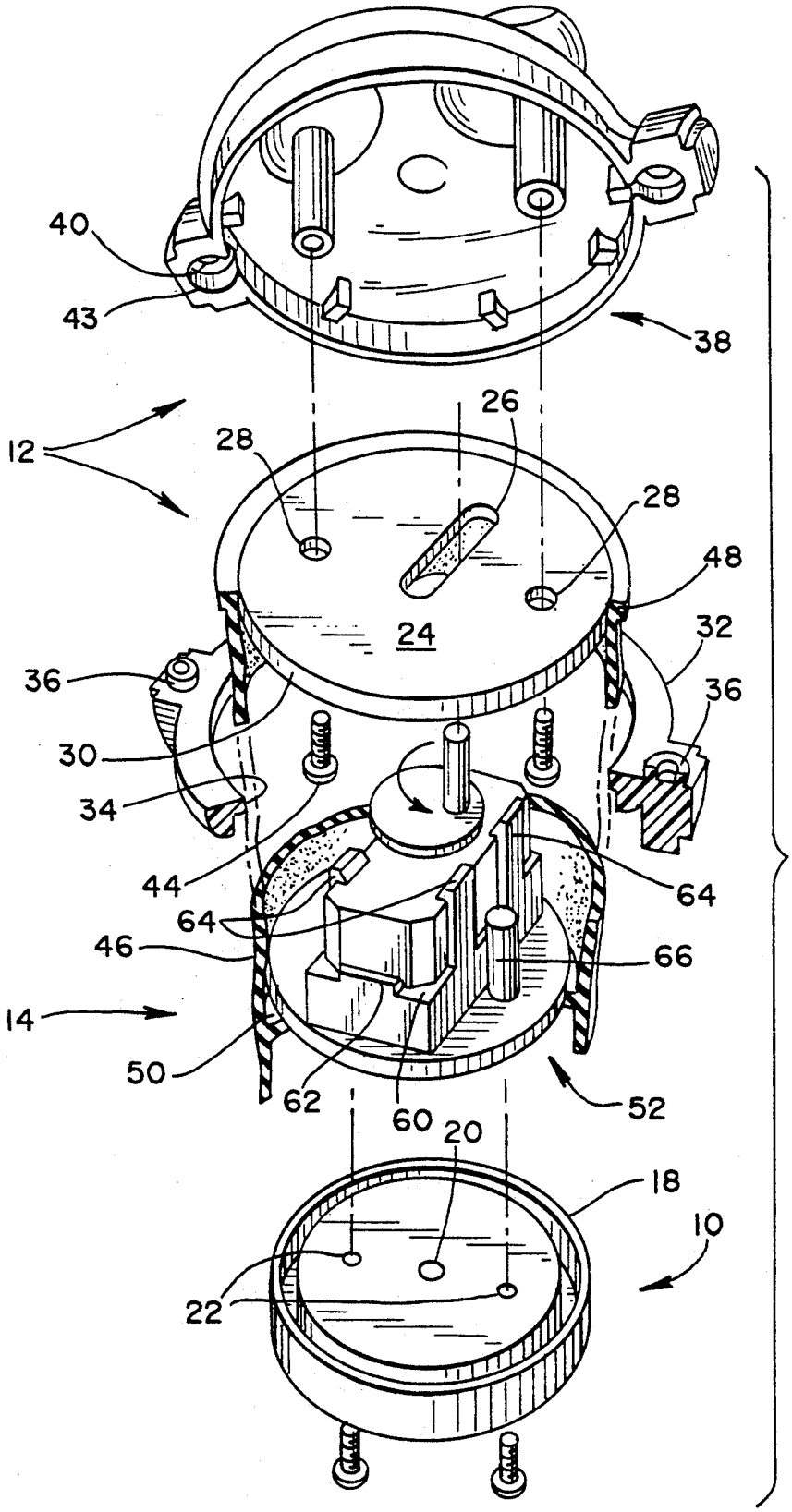
FIG. 1 is an exploded and broken away view of the animated wind up toy in accordance with the present invention.

The animated toy has a base 10, and a top member 12 that is connected to base 10 by a body portion 14. A wind up motor 16, supported on the base portion, imparts an orbital motion to a cam 72 that reacts with a cam follower 26 that is carried by top member 12. The base 10 and top member 12 are of a thickness that when molded from a plastic material such as polyvinyl chloride they are soft but have structural rigidity. The body portion 14 has a thickness such that when it is molded from soft resilient elastomer material it can flex and bend and thus relative movement between top member 12 and base 10 is permitted. A swaying movement is imparted to the top member and a rocking and bending movement is imparted to the body portion 14. These movements give the impression that the animated toy is swaying and dancing.

The swaying and dancing motion further inhanced by having the wind-up knob 80 extend below the bottom surface of base 10. A turning and rocking movement generated by the means of the rotation of knob 80 as it unwinds.

Base 10 has an overall circular shape, in the illustrated embodiment, and includes a peripheral upwardly opening groove 18, a pair of fastening means openings 22 and an opening 20 through which the wind up shaft 17 of motor 16 extends. As can be best seen in FIGS. 2, 3 and 6 the undersurface of base 10 is countersunk which provides a cavity in which the motor wind up knob 80 and the fastening means 25 are housed. This depressed housing for the knob 80 and fastening means 25 protect the person handling the animated toy from these projections.

As illustrated in FIG. 1 the top member 12 includes a cap 38, a disc 24, and a locking ring 32. The outward facing contour of cap 38 is shaped to resemble a particular type of food and can also be shaped to give the toy facial features such as eyes, nose or mouth or other decorative adornment. The resemblance of cap 38 to a particular type of food is further enhanced by the color scheme that is applied to the cap. However the functional features of the cap 38 are the same regardless of the type of food that is suggested by its outward contour and color.

Cap 38 has a pair of fastening means openings 40 formed at diametrically opposite points. The fastening means openings 40 are countersunk into the outward facing surface so that the head of fastening means 42 are indented below the adjacent surfaces. By so indenting the fastening means 42 a person handling the toy will not contact the fastening means 42 and there is less likelihood that it could scratch or cut the person. Further the fastening means will be less likely to be accidentally loosened and will be out of view. A pair of aligning pin openings 43 that are larger in diameter but concentric with openings 40 are formed in the lower surface of the cap 38. The fastening means openings 40 are centered in aligning pin openings 43 formed in the lower surface of cap 38.

The outer surface of locking ring 32 is contoured and has a color scheme that complements the contour and colors of cap 38. Locking ring 32 has an inwardly facing cylindrical surface 34 the purpose for which will be discussed below. Upwardly projecting aligning pins 36 are formed integrally with locking ring 32. The aligning pins 36 are spaced diametrically from each other such that they can be aligned with and received in the aligning pin openings 43. Fastening means 42 extend through fastening means opening 40 and into the aligning pins 36 to thereby secure locking ring 32 to cap 38.

A disc 24 having an outwardly facing cylindrical surface 30 is secured to the bottom surface of cap 38 by fastening means 44 that extend through fastening means openings 28 formed in the disc 24. A cam follower slot 26 is formed in disc 24 for cooperation with a cam as will be discussed in more detail below.

When top member 12 has been assembled, by connecting locking ring 32 and disc 24 to the cap 38, the outwardly facing cylindrical surface 30 and the inwardly facing cylindrical surface 34 are arranged concentrically and there is a small space therebetween, for a purpose that will be discussed below.

The body 14 is formed, for example by injection molding, from a soft elastomer material. Body 14 has a generally vertically extending tubular soft thin-skin portion 46. The vertically extending tubular portion has a top end portion and a bottom end portion. Features of the particular food item are depicted in colors on the outer surface of body 14 but regardless of the particular food item that is depicted the basic mechanical design of body 14 is not changed. A rim 48, having dimensions greater than the thickness of thin skin of the tube 46, is formed along the upper edge of the top end portion of body 14. A pair of transverse webs 50 are formed integral with the bottom end portion along the inner surface of vertically extending tube 46. Fastening apertures 51 are formed in transverse webs 50.

A motor mount 52 having a disc shaped base 54 is formed with an opening 56 through which the wind up shaft of the motor extends. The motor mount 52 also includes a cradle 60 that is shaped and dimensioned to receive the wind up motor 16. Motor 16 is a spring wound prime mover capable for and intended for use in toys such as is disclosed in U.S. Pat. No. 4,478,313. The cradle includes a pair of end stops 62 that engage the longitudinal ends of the wind up motor 16 and two sets of flexible pawls 64 that snap around the wind up motor 16 to secure it in place. The size and shape of cradle 60 will of course be determined by the size and shape of the motor 16 that is used. The motor mount includes a pair of posts 66 for receiving the fastening means 25 that connect the base 10 and the transverse webs 50 to the motor mount 52.

As can be best seen in FIGS. 2 and 3 motor 16 includes a wind up shaft 17 and an output shaft 68 having a disc 70 secured to its upper portion. A cam 72 is secured to disc 70 and extends upwardly from a point on the disc that is offset from the motor output shaft 68. This arrangement results in wind up motor 16 imparting an reaction between cam 72 and cam follower 26 has caused the top 12 to be moved to the left. The relative location of cam 72 and cam follower 26 of FIG. 2 are shown in full lines in FIG. 4. As seen in FIG. 3 the cam 72 is at its extreme right position. In FIG. 3 the reaction between cam 72 and cam follower 26 has caused the top 12 to be moved to the right. The relative location of cam 72 and cam follower 26 of FIG. 3 are shown in broken lines in FIG. 4. During the movement of top 12, from its FIG. 2 position to its FIG. 3 position, base 10 remains stationary. As can be seen in FIG. 4 there is some back to front movement as top 12 moves from its FIG. 2 position to its FIG. 3 position. The thin-skin portion 46 of body 14 flexes and sways as top 12 oscillates. This movement of the thin-skin portion 46 of the body gives the impression that the animated toy is rocking and dancing.

FIG. 5 shows an example of the animated toy in the form of a milk shake. In this particular food item the top 12 is shaped such that there are a pair of bulging eyes, an open mouth, a straw and a pair of ear phones. In this figure a portion of the thin-skin 46 is broken away and the motor 16 secured in place on the motor mount 52 by a stop 62 and a flexible pawl 64. A portion of the motor output shaft 68 and connected disc 70 can also be seen through the opening in thin-skin 46.

FIG. 6 is another view of the FIG. 5 example of the animated toy. This figure shows the toy from the rear looking up. In this figure a portion of the thin-skin 46 is broken away and cam 72 and cam follower 26 are clearly visible.

The compact, durable and safe attributes of the animated toy can be appreciated when viewing FIGS. 5 and 6. There are no fragile projections that can be broken off or injure the player, it is of a shape that can be easily grasp by a child and only soft flexible plastic material is exposed.

Although the present invention has been described in terms of the specific preferred embodiment, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. An animated toy that resembles a selected article comprising:

a base;

a motor, having an output shaft, secured to said base, a top member;

a vertically extending tube, formed from soft thin skin elastomer material, having top and bottom end portions;

said bottom end portion connected to said base;

means connecting said top end portion to said top member such that said motor and output shaft are within said vertically extending tube, including:

an outwardly facing cylindrical surface, on said top member, dimensioned to extend downwardly into the top end portion of said vertically extending tube, a locking ring, on said top member, having an inwardly facing cylindrical surface dimensioned to receive said outwardly facing cylindrical surface with sufficient clearance therebetween for the thin skin of said vertically extending tube, the upper most edge of said vertically extending tube having a rim formed thereon dimensioned to be larger than the clearance between said outwardly and inwardly facing cylinders such that, when said locking ring is secured to said top member, said vertically extending tube is secured to said top member;

a cam follower carried by said top member;

a cam carried by said output shaft in operating engagement with said cam follower, whereby movement is imparted from said motor to said top member and through said top member to said vertical tube such that said top member and said vertical tube appear to wiggle and dance.

2. An animated toy as set forth in claim 1, wherein said cam follower is formed in a disc that is secured to the bottom of said top member.

3. An aminated toy that resembles a selected article comprising:

a base;

a motor, having an output shaft, secured to said base;

a top member;

a vertically extending tube, formed from soft thin skin elastomer material, having top and bottom end portions;

said bottom end portion connected to said base;

means connecting said top end portion to said top member such that said motor and output shaft are within said vertically extending tube;

a cam follower carried by said top member;

a cam carried by said output shaft in operating engagement with said cam follower, whereby is imparted from said motor to said top member and through said top member to said vertical tube such that said top member and said vertical tube appear to wiggle and dance;

said base includes an upwardly opening groove that is adapted to receive the bottom end portion of said vertically extending tube;

a motor mount including a motor receiving nest and flexible pawls for securing said motor in said nest;

means for fastening said motor mount to said base; and said means connecting the bottom end portion of said vertically extending tube to said base includes a transverse web in the bottom end portion of said vertically extending tube adapted to lay between said motor mount and said base and to be secured thereto by said means for fastening said motor mount to said base.

4. An animated toy that resembles a selected article comprising;

a base;

a motor, having an output shaft, secured to said base;

a top member;

a vertically extending tube, formed from soft thin skin elastomer material, having top and bottom end portions;

said bottom end portions connected to said base;

means connecting said top end portion to said top member such that said motor and output shaft are within said vertically extending tube;

a cam follower carried by said top member;

a cam carried by said output shaft in operating engagement with said cam follower, whereby movement is imparted from said motor to said top member and through said top member to said vertical tube such that said top member and said vertical tube appear to wiggle and dance;

said base includes an upwardly opening groove that is adapted to receive the bottom end portion of said vertically extending tube;

a motor mount including a motor receiving nest and flexible pawls for securing said motor in said nest;

means for fastening said motor mount to said base; and said means connecting the top end portion of said vertically extending tube to said top member includes:

an outwardly facing cylindrical surface, on said top member, dimensioned to extend downwardly into the top end portion of said vertically extending tube;

a locking ring, on said top member, having an inwardly facing cylindrical surface dimensioned to receive said outwardly facing cylindrical surface with sufficient clearance therebetween for the thin skin of said vertically extending tube; and the upper most edge of said vertically extending tube having a rim formed thereon dimensioned to be larger than the clearance between said outwardly and inwardly facing cylinders such that, when said locking ring is secured to said top member, said vertically extending tube is secured to said top member.

5. An animated toy that resembles a selected article comprising;

a base;

a motor, having an output shaft, secured to said base, a motor mount including a motor receiving nest and flexible pawls for securing said motor in said nest, and means for fastening said motor mount to said base;

a top member;

a vertically extending tube, formed from soft thin skin elastomer material, having top and bottom end portions;

means connecting said bottom end portion to said base including:

a transverse web in the bottom end portion of said vertically extending tube adapted to lay between said motor mount and said base and to be secured thereto by said means for fastening said motor mount to said base;

means connecting said top end portion to said top member such that said motor and output shaft are within said vertically extending tube;

a cam follower carried by said top member; and a cam carried by said output shaft in operating engagement with said cam follower, whereby movement is imparted from said motor to said top member and through said top member to said vertical tube such that said top member and said vertical tube appear to wiggle and dance.

6. An animated toy as set forth in claim 5, wherein said means connecting the top end portion of said vertically extending tube to said top member includes;

an outwardly facing cylindrical surface, on said top member, dimensioned to extend downwardly into the top end portion of said vertically extending tube, a locking ring, on said top member, having an inwardly facing cylindrical surface dimensioned to receive said outwardly facing cylindrical surface with sufficient clearance therebetween for the thin skin of said vertically extending tube, the upper most edge of said vertically extending tube having a rim formed thereon dimensioned to be larger than the clearance between said outwardly and inwardly facing cylinders such that, when said locking ring is secured to said top member, said vertically extending tube is secured to said top member.

* * * * *